United States Patent [19]

Gagnon

[11] 4,101,987

[45] Jul. 25, 1978

[54] DAMAGE PREVENTIVE DEVICE FOR SWIMMING POOLS

[76] Inventor: Real Gagnon, 5827-3rd Ave., Rosemont, Quebec, Canada

[21] Appl. No.: 745,971

[22] Filed: Nov. 29, 1976

[51] Int. Cl.[2] ..... E04H 3/16; E04H 3/18

[52] U.S. Cl. ..... 4/172; 4/1

[58] Field of Search ..... 4/1, 172, 172.15, 172.11, 4/172.16, 172.18; 138/126, 127, 128

[56] References Cited

U.S. PATENT DOCUMENTS

| | | | |
|---|---|---|---|
| 186,305 | 1/1877 | Bujac | 138/28 |
| 3,390,406 | 7/1968 | Strout et al. | 4/1 |
| 3,411,163 | 11/1968 | Myers, Jr. | 4/172 |
| 3,596,295 | 8/1971 | Wilson | 4/172.15 |
| 3,629,878 | 12/1971 | Martin | 4/172 |

*Primary Examiner*—Henry K. Artis

[57] ABSTRACT

A device for preventing damage, by ice, to a swimming pool. It comprises a frame fixed in an immovable position within the swimming pool filled with water. At least a portion of the fixed frame is positioned to be encased in thawing ice in the pool as the frozen water starts to melt. The purpose is to prevent the thawing ice sticking to the frame from banging into the walls of the pool.

3 Claims, 4 Drawing Figures

DAMAGE PREVENTIVE DEVICE FOR SWIMMING POOLS

This invention is directed toward a damage preventive device for swimming pools. The invention is more particularly directed toward damage preventive devices for thin-walled swimming pools, particularly of the above-ground type.

The latter normally have a relatively thin outer retaining wall since such pools are usually not more than 4 to 6 feet deep. While the pool is not too deep, it still holds a relatively large volume of water. Draining of the pool for the winter presents the pool owner with a problem, particularly when the pool is located on a small lot. It is therefore often preferable to leave the water in the pool through the winter. The water freezes in cold weather but since the walls of the pool are thin, they are somewhat flexible and the pool is not damaged by the expanding ice. In the spring however, as the ice melts it forms, at one stage, a heavy ice mass floating in water formed from already melted ice. In a heavy wind, this heavy movable ice mass can be battered against the thin retaining wall of the pool causing damage and possibly even collapse of the pool.

The present invention therefore proposes a device for preventing swimming pools from being damaged by floating ice masses. The device comprises a frame to be inserted into the water in the pool in the fall before the water freezes and after it gets too cold to use the pool. The frame has means for immovably fixing it in the pool with a portion located so as to be at least partially encased by ice within the pool when the water freezes.

Thus as the ice thaws in the spring, the frame, at least partially encased by the ice, prevents the melting ice mass from moving about in the pool and cause possible damage to the wall of the pool. Once the ice has substantially melted, and the frame is no longer encased, it can be removed from the water in the pool and stored until the fall again. The frame preferably is made in sections so that it can be dismantled and easily stored in a relatively small space. Preferably also the frame is made to be adjustable to enable it to be used in pools of different size.

Embodiments of the invention will now be described in detail having reference to the accompanying drawings in which.

Figure 1:
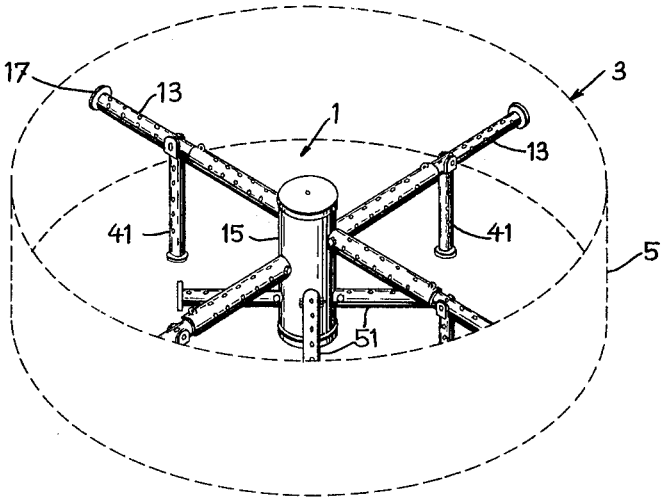
FIG. 1 is a perspective view of the device installed in a circular swimming pool.
Figure 4:
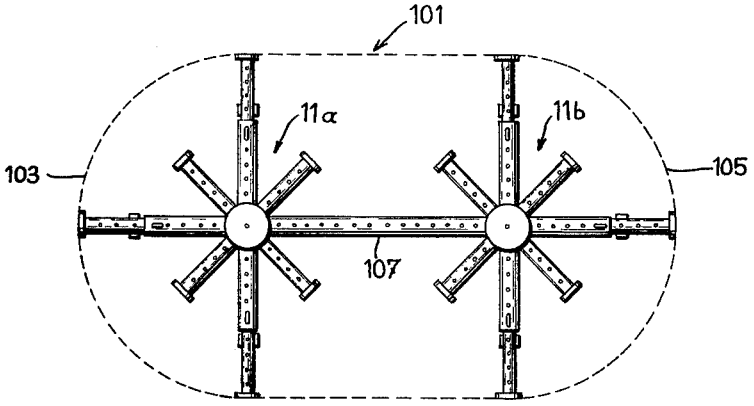

FIG. 4, on the same sheet as FIG. 1, is a plan view of a device for use in an oval swimming pool.

Figure 2:
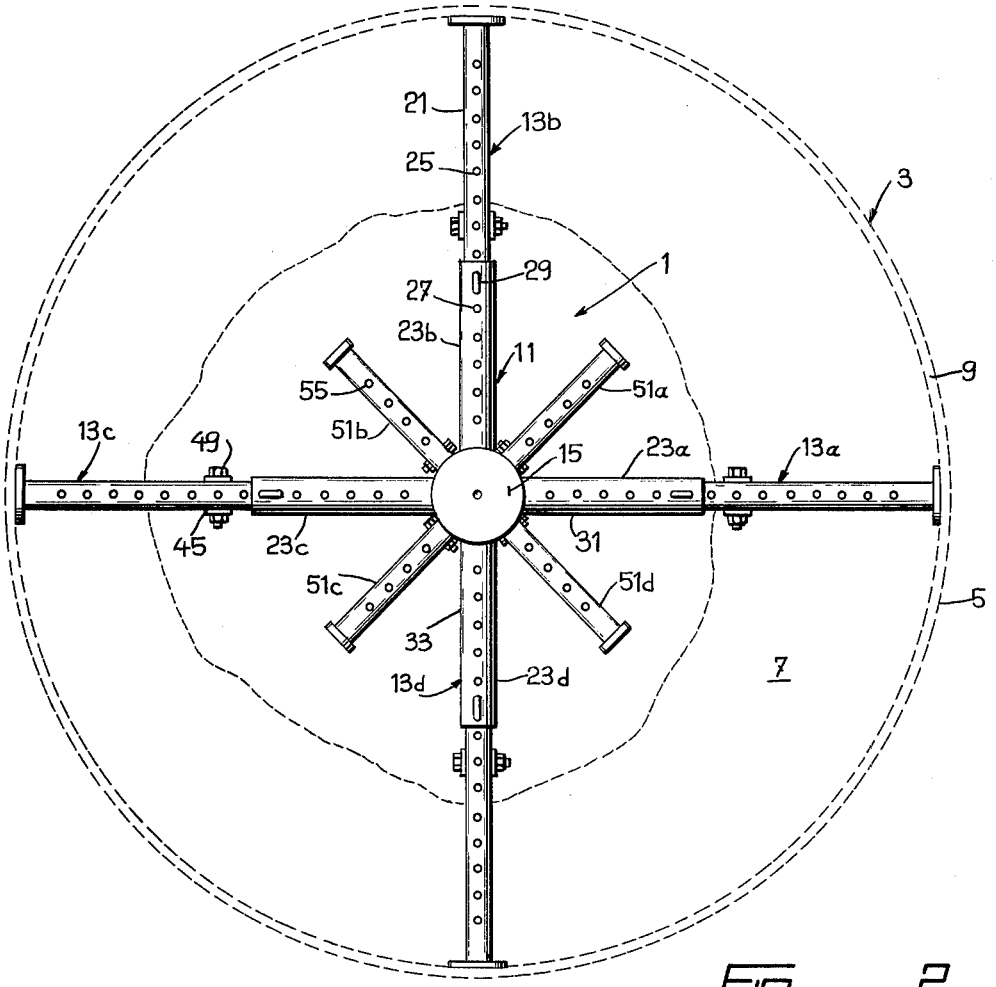
FIG. 2 is a plan view of the device in the swimming pool.

The damage preventive device 1 of the present invention is designed for thin-walled swimming pools, particularly the above-ground type of swimming pool. Above-ground swimming pools 3 have a relatively thin, outer, vertical retaining wall 5 to provide the shape of the pool which shape is usually circular as shown in FIGS. 1 or 2. The wall 5 can be made from thin steel or aluminum sheet and can be 4 to 6 feet high, by way of example. The wall 5 is generally self-supporting, but may be stiffened with braces (not shown) on its outside surface.

A flexible liner 7 is placed within the retaining wall 5 to lie on the ground "G" and against the inner surface of wall 5. It can be secured at its top edge to the top edge of wall 5 by a retaining ring 9. The liner 7 is made from water impermeable material such as a suitable thermoplastic material and serves to retain the water "W" in the pool to the shape dictated by the wall 5 and the ground.

In accordance with the invention, the illustrated damage preventive device 1 comprises a rigid frame 11, shown as inserted into the pool 3. The frame 11 has means for retaining it in a fixed position within the pool with a least a portion of such frame positioned within the pool to be encased by ice block "I". This ice block forms in the pool when the water "W" is left in the pool, in the fall, freezes, and then starts to melt in the spring.

The frame retaining means comprise a plurality of arms 13 extending radially from a central point on the frame out against wall 5. The arms 13 preferably extend radially from a centrally located vertical tubular post 15 resting on the bottom of the pool. The arms 13 preferably are located well above the bottom of the pool, just slightly below the water line "L", and extend substantially parallel to the water line. Each arm 13 has a cushioning pad at its free end 19 to bear against the wall 5 of the pool and it is pushed tight against the wall 5 and locked against it to retain the frame 11 in a fixed position within the pool.

The block of ice "I" encases the arms 13, and post 15, if used, when the water freezes. As the ice "I" thaws in the spring, it continues to encase at least the central portion of arms 13 and the upper portion of post 15, and is thus prevented from moving towards the pool sidewall 5.

It is to be understood that the arms 13 can be retained in a position above the floor of the pool without the use of vertical post 15 merely by the lateral clamping force exerted by the arms. It is preferred however to use post 15 to reduce to a minimum the lateral clamping force exerted on the wall 5.

Figure 3:
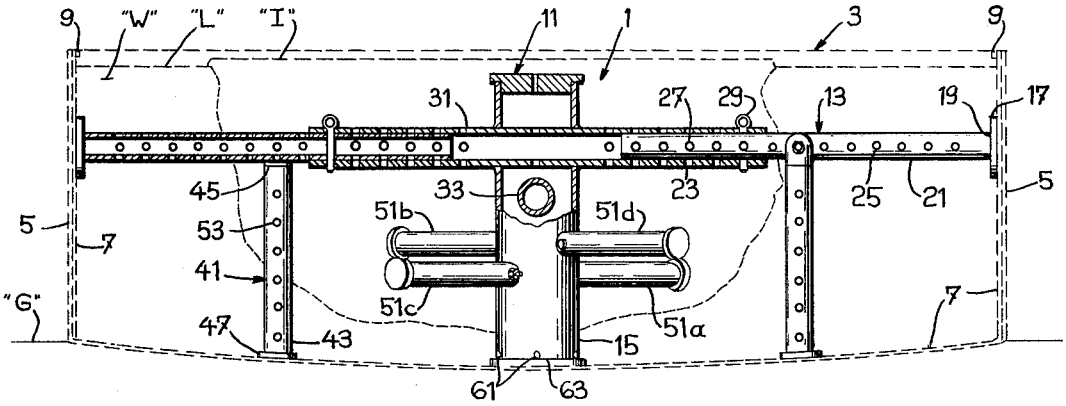
FIG. 3 is a cross-sectional view taken along line III—III in FIG. 2.

In a circular pool as shown in FIGS. 1 to 3, the frame 11 can have four radially extending arms 13 spaced 90° apart. Each arm 13 is made to be adjustable in length so that the device can be used in pools of different diameters. To this end, each arm 13 comprises an outer section 21 adjustably mounted on an inner section 23 which in turn is fixed to post 15. Outer and inner arm sections 21, 23 comprise tubular members with outer tube 21 telescopically mounted within inner tube 23. Each tube 21, 23 can be provided with rows of holes 25, 27 respectively and the telescoped tubes are locked together, when the arms are pushed tight against wall 5, with a pin 29 passed through aligned holes 25, 27 in the tubes.

To reduce the number of parts, inner tubes **23*a*, 23*c*, 23*b*, 23*d* of opposed arm pairs 13*a*, 13*c* and 13*b*, 13*d* respectively, can comprise a single tube member 31, 33 passed through holes in post 15 and centrally located thereto with tube member 31 positioned above tube member 33 and extending perpendicular thereto. The tube members 31, 33 could be fixed to post 15** by suitable means such as welding, detachably connected thereto.

Support legs 41 are preferably provided for arms 13 intermediate their free ends 19 and central post 15. Legs 41 each comprise a tubular post 43 having an upwardly opening U-shaped bracket 45 at its upper end, and a foot pad 47 at its lower end for resting on the bottom of the pool. A pin 49 connects the legs of bracket 45 to arm 13 via a hole 23 or 25. The legs 41 can be used in larger pools to partially support the weight of the longer arms 13 and to provide additional frame structure to be encased by the ice.

If desired, an additional set of ice encasable arms 51 can be provided on post 15 extending a short distance radially therefrom. Four arms 51A, 51B, 51C and 51D could be provided, beneath arms 13 and above the pool bottom, extending radially outward from post 15 and positioned between arms 13. Arms 51 provide additional means to "lock" the ice "I" to frame 11. Each arm 51 can comprise a short tubular member detachably connected to post 15.

Legs 41 and arms 51 can be provided with rows of holes 53, 55 respectively, to both lighten them, and to permit water drainage when removing the frame from the pool after the ice has thawed. Central post 15 can also be provided with a set of drain holes 61 adjacent its bottom end 63 to drain it when removing the frame.

In an oval pool 101, as shown in FIG. 4, two frames 11A, 11B could be used, one located at each end 103, 105 of the pool. The radial arms from each frame 11A, 11B which extend toward each other are replaced by a single arm 107 fixing the frames 11A, 11B together.

The frames 11, 11A, 11B are easily dismantled and stored in a relatively small space during the summer.

I claim:

1. A device for preventing a thin walled swimming pool of the above-ground type, which contains water, from being damaged by floating ice masses in the fall or spring, which device comprises a frame to be inserted into the water within the pool before the water freezes and after it gets too cold to use the pool, said frame comprising: a vertical post to be centrally positioned on the bottom of the pool, said post to become at least partially encased by the ice within the pool when the water freezes; a plurality of telescopic arms extending radially from the post toward the walls of the pool and means to adjust the length of said arms to bias the ends of said arms against the walls of the pool thereby immovably fixing the frame with respect to the walls of the pool to prevent ice masses from moving about in the pool and cause possible damage to the walls thereof.

2. A device as claimed in claim 1, wherein the telescopic arms extends radially from the post at such a level that they are also encased by the ice within the pool when the water freezes.

3. A device as claimed in claim 1, wherein the telescopic arms are provided with support legs located intermediate their ends and the central post, said support legs extending downwardly from said arms to the bottom of the pool.

* * * * *